US007267202B2

(12) United States Patent
Sirag, Jr.

(10) Patent No.: US 7,267,202 B2
(45) Date of Patent: Sep. 11, 2007

(54) ELEVATOR DISPATCHING WITH GUARANTEED TIME PERFORMANCE USING REAL-TIME SERVICE ALLOCATION

(75) Inventor: David J. Sirag, Jr., Ellington, CT (US)

(73) Assignee: Otis Elevator Company, Farmington, CT (US)

( * ) Notice: Subject to any disclaimer, the term of this patent is extended or adjusted under 35 U.S.C. 154(b) by 161 days.

(21) Appl. No.: 10/552,117

(22) PCT Filed: May 13, 2003

(86) PCT No.: PCT/US03/15172

§ 371 (c)(1),
(2), (4) Date: Oct. 4, 2005

(87) PCT Pub. No.: WO2004/106208

PCT Pub. Date: Dec. 9, 2004

(65) Prior Publication Data

US 2006/0191748 A1 Aug. 31, 2006

(51) Int. Cl.
*B66B 1/18* (2006.01)

(52) U.S. Cl. ..... 187/382; 187/387

(58) Field of Classification Search ..... 187/247, 187/248, 380–389

See application file for complete search history.

(56) References Cited

U.S. PATENT DOCUMENTS

| | | | | |
|---|---|---|---|---|
| 4,760,896 | A | 8/1988 | Yamaguchi | |
| 4,802,557 | A * | 2/1989 | Umeda et al. | 187/387 |
| 5,020,642 | A * | 6/1991 | Tsuji | 187/382 |
| 5,058,711 | A * | 10/1991 | Tsuji | 187/383 |
| 5,672,853 | A | 9/1997 | Whitehall et al. | |
| 5,955,708 | A | 9/1999 | Amano et al. | |
| 6,145,631 | A * | 11/2000 | Hikita et al. | 187/383 |

OTHER PUBLICATIONS

PCT International Search Report for PCT/US03/15172, dated Dec. 11, 2003.

International Preliminary Examination Report for PCT/US03/15172, dated May 25, 2005.

* cited by examiner

*Primary Examiner*—Jonathan Salata

(57) ABSTRACT

The registration of each hall call (20, 21) is recorded (27) and the remaining response time of all available cars to each up hall call and each down hall call is determined. The response time for each car to answer is compared against a limit and a table indicates whether that car can answer that call in less than the wait time limit or not. The time limit may be adjusted upwardly or downwardly.

2 Claims, 5 Drawing Sheets

ELEVATOR DISPATCHING WITH GUARANTEED TIME PERFORMANCE USING REAL-TIME SERVICE ALLOCATION

TECHNICAL FIELD

This invention relates to elevator dispatching in which elevators stop at floors only if (a) there is a hall call in the car's direction at that floor or (b) no other available car in the system will be able to answer the call within a registration time limit.

BACKGROUND ART

One successful elevator dispatching system keeps reassigning hall calls to cars several times a second, so as to take into account all of the changes in the system as they occur. Other elevator dispatching systems are bent on allocating hall calls to cars once and for all, so that the elevator that is to be responding to the hall call can be announced at the landing, as soon as possible. All systems take into account, in some fashion, the length of time it will take any given elevator to reach a hall call, based on such information as is available about the call car's location and other stops it may have to make. All of these dispatching systems have special features to accommodate hall calls that are waiting for more than some maximum time, to avoid starting up cars if other cars can serve almost as well, to avoid bunching of cars, and the like. Despite all of the nuances which have been used, bunching of cars and calls that are waiting for excessive amounts of time still universally occur.

DISCLOSURE OF INVENTION

Objects of the invention include: elevator dispatching which tends to balance the registration times of hall calls while avoiding worst-case situations; elevator dispatching which retains flexibility due to adequate slack in the system; and improved elevator dispatching.

The invention is predicated on the discovery that assigning cars to answer hall calls in a manner to achieve somewhat poor behavior of the system at all times will nonetheless retain sufficient elasticity in the system to avoid worst-case behavior (that is excessively long waits for hall calls).

According to the present invention, elevator cars are not assigned to calls, but simply stop at floors only if the car has a car call for a given floor, or if there is no other car that can stop at that floor to answer a hall call in the car's direction within a call wait time limit. The predicted response time of a car to the various calls is not used to determine anything about that car, but only used to determine if some other car might be one which can answer the call within a call wait time limit.

The invention departs radically from conventional hall call allocation methodology, by not allocating hall calls to cars, but simply causing cars to stop, as determined when a car reaches the committable floor for a call in the same direction.

According further to the present invention, the call wait limit can be adjusted to be shorter during light periods of traffic and to be longer during heavy periods of traffic, in a variety of ways.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 2: recording hall call's registration time;
FIG. 3: creating a table of expected waiting times;
FIG. 4: elevator car stop control;
FIG. 5: lowering the wait time limit; and
FIG. 6: alternative adjusting of the wait time limit.

MODE(S) FOR CARRYING OUT THE INVENTION

Figure 1:
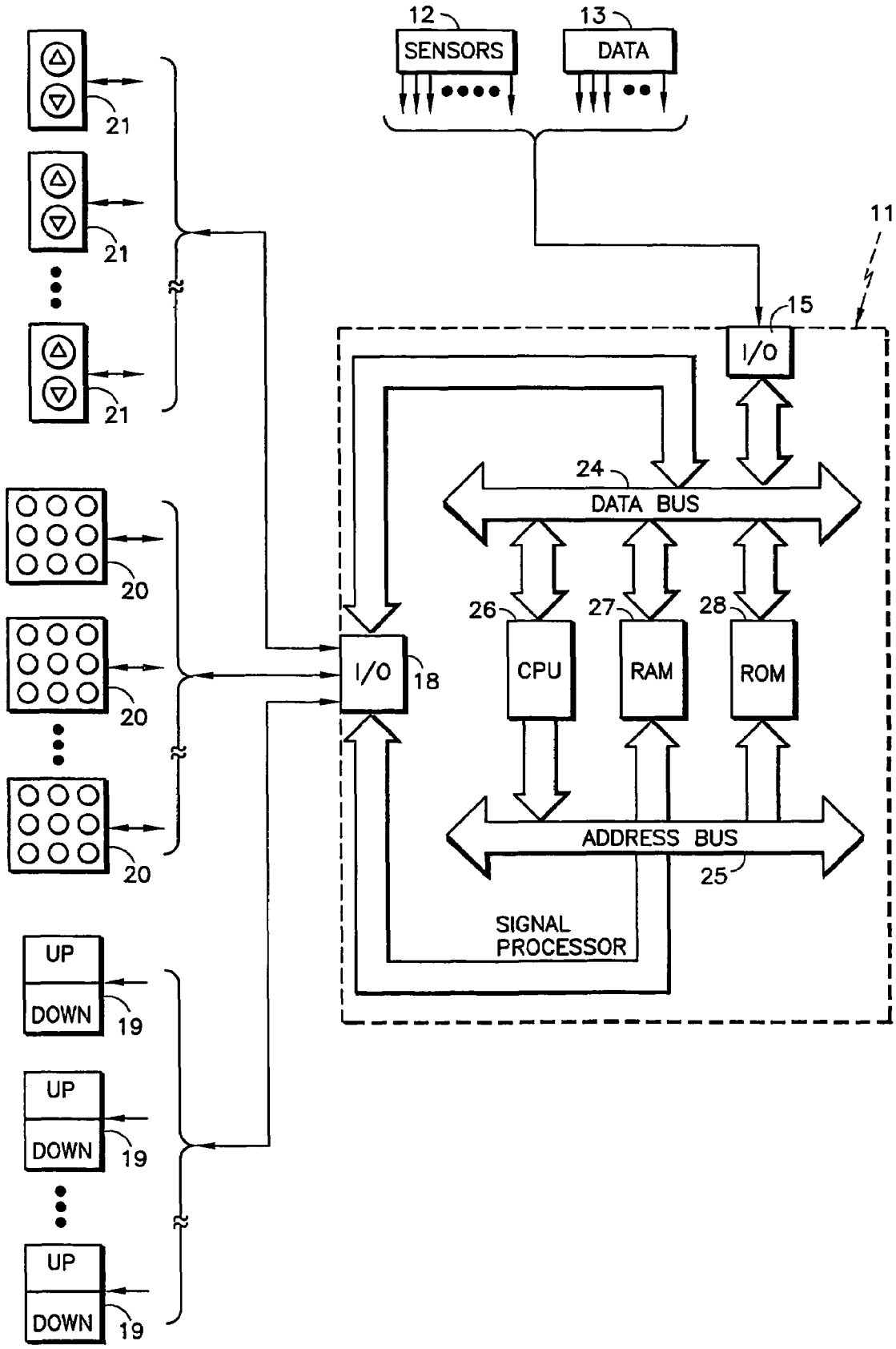
FIG. 1 is a schematic diagram of a conventional computer arrangement interfacing with elevators, as an example of a system in which the present invention may be practiced.

Referring to FIG. 1, a signal processor 11 is illustrative of group controllers that may allocate cars to respond to hall calls, utilizing aspects of the present invention. The processor 11 is responsive to a plurality of sensors 12, such as car weight sensors, and data signals 13, such as car direction and door condition, provided to an input/output (I/O) port 15 of the processor 11. Similarly, another I/O port 18 is connected to a plurality of hall call buttons 19 resident on the various floors of the building, a plurality of car call button panels 20, one resident in each car, and a plurality of hall lanterns 21, of which there are typically one or more at each floor landing. The processor 11 includes a data bus 24, an address bus 25, a central processing unit (CPU) 26, a random access memory (RAM) 27, and a read only memory (ROM) 28 for storing the requisite elements of programs or routines that can carry out the present invention.

Figure 2:
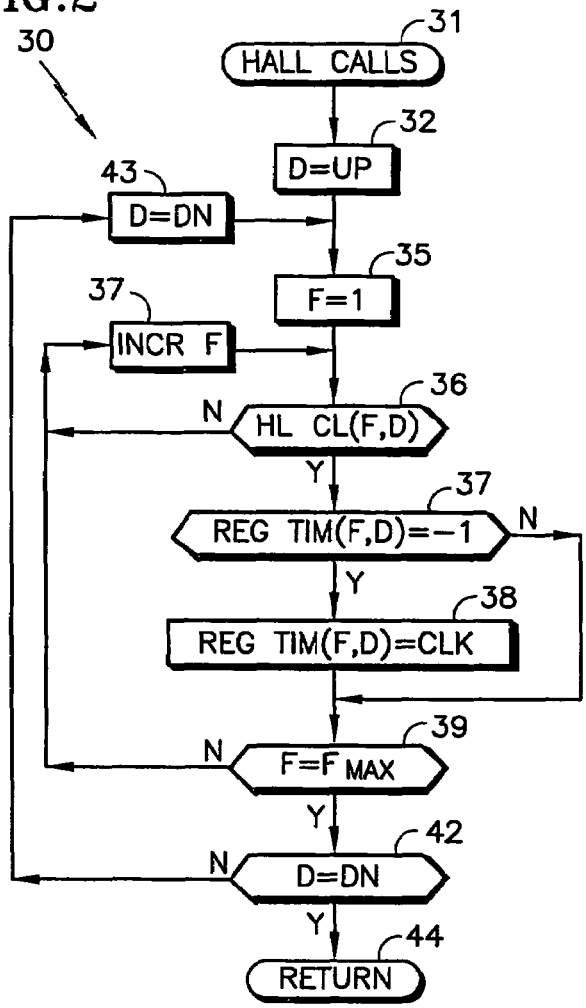
FIGS. 2-6 are simplified logic flow diagrams which are exemplary of processes that may be utilized to practice the present invention, as follows.

Referring to FIG. 2, a routine 30 for recording the registration time of hall calls is reached through an entry point 31 and a first step 32 sets a direction indicating factor, D, to "UP". A step 35 sets a floor indicator, F, to one, and then a test 36 determines if there is a hall call on floor F in direction D, which is now an UP call at floor one. If not, a negative result of test 36 reaches a step 37 to increment F so as to test the next floor in turn. If there is an UP hall call at floor F, an affirmative result of test 36 reaches a test 37 to determine if the registration time for the UP call at floor one is set to −1 or not. In this embodiment, any time a registration time is set equal to −1, that means that either no call has been registered, or having just been registered, the registration time for it has not yet been recorded. If it set to −1, that means that this is the first pass through the routine of FIG. 2 that this particular hall call has been considered so an affirmative result of test 37 reaches a step 38 to record the registration time of the UP call at floor F as present clock time. On the other hand, if test 37 is negative, this means that the registration time for this call has previously been set and should be left alone, so a negative result of test 37 bypasses step 38.

Then, a test 39 determines if the floor pointer is pointing to the highest floor. Initially it will not be, so a negative result of test 39 reaches a step 37 to increment F in order to test the next floor in turn. When all of the floors have been tested, test 39 will be affirmative reaching a test 42 to determine if the direction pointer is set to down, or not. Initially it will not be, so a negative result of test 42 reaches a step 43 to adjust the direction pointer to indicate "DOWN". Then the steps and tests 35-42 are repeated for the next floor, with respect to all of the cars. When all of the floors have been tested with respect to all of the cars, for both the up and down directions, test 42 will be affirmative causing other programming to be reverted to through a return point 44. If parallel processing is being used, the affirmative result of test 42 can cause the program to revert to step 32 and thereby have the recordation of hall call times operate continuously.

Figure 3:
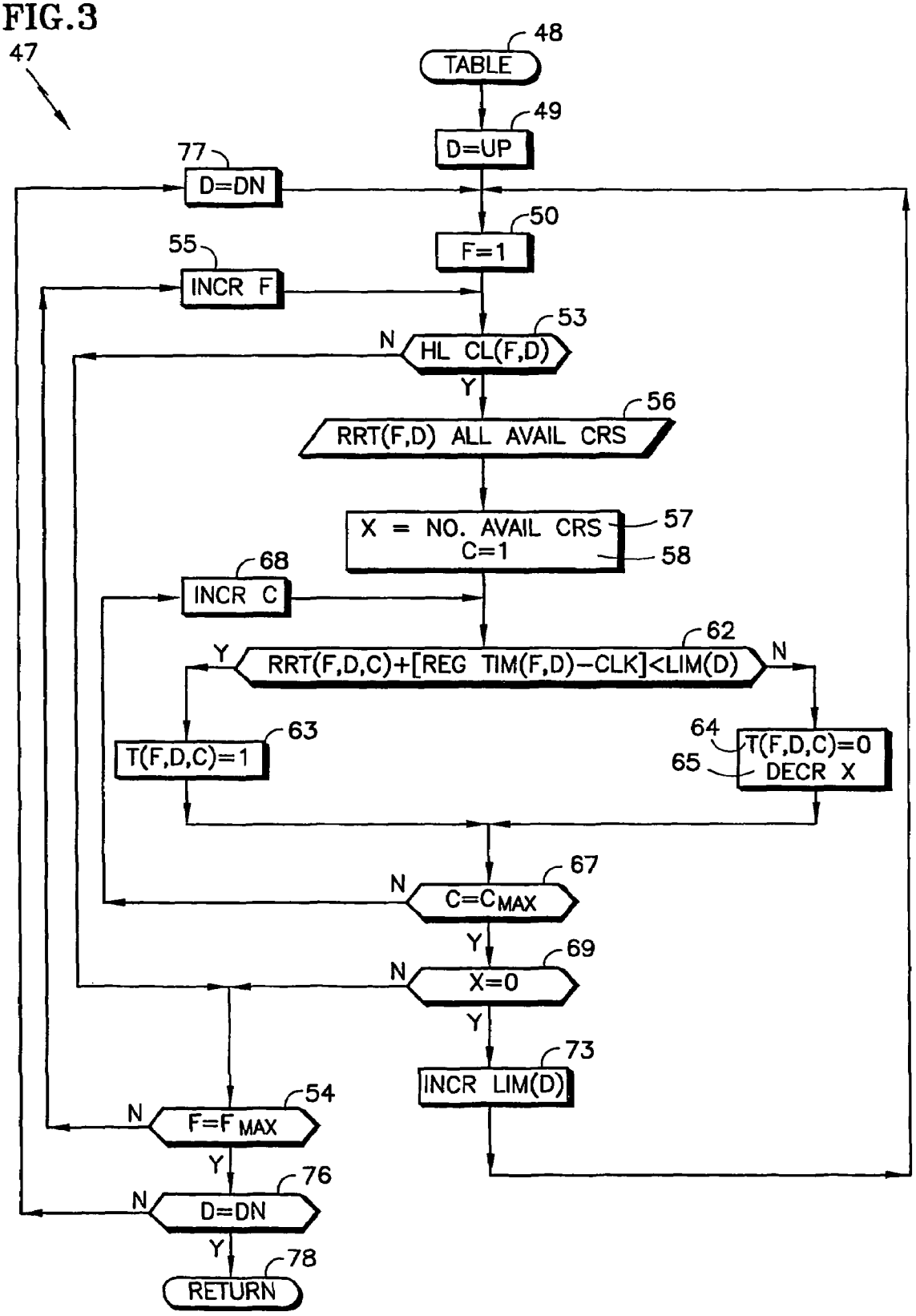

Referring to FIG. 3, a routine 47 for recording the time required for cars to reach calls is entered through a point 48 and a first test 49 sets the direction pointer to UP. Then, a step 50 sets a floor pointer equal to one, and a test 53 will determine if there is a hall call at floor F in the direction of the direction pointer, D. If not, a negative result of test 53 reaches a step 54 to determine if the highest floor has been reached. If not, a negative result of test 54 reaches a step 55 to increment the floor pointer. And then test 53 is repeated; if there is a hall call at this floor, then a subroutine 56 will determine the remaining response time to reach the call at floor F in direction D for all available cars. This may be determined by means of suitably trained neural networks as is set forth in U.S. Pat. No. 5,672,853. Alternatively, other known remaining response time algorithms may be used if desired.

A step 57 sets X equal to the number of available cars and a step 58 sets a car pointer, C, equal to one. Then a test 62 determines if the total wait time for the call at floor F in direction D, if answered by car C, is less than the wait time limit for this direction, LIM(D). This is achieved by adding to the remaining response time for car C to reach this hall call, the difference between the registration time and the present time. If the total waiting time is less than the limit, a step 63 will set a table entry, T, for this floor call and direction related to car C equal to ONE; but if the total waiting time is beyond the limit, a negative result of test 62 reaches a step 64 to set the table entry for this call and car to ZERO. Then a step 65 decrements the number of available cars, X, for a purpose described below.

A test 67 determines if all of the cars have been tested with respect to the call at floor F and direction D. If they have not, a negative result of test 67 reaches a step 68 to increment C so that the next car in turn can have its total wait time to reach the call in question computer, stored, and compared with the limit. When all of the cars have been tested with respect to this call, an affirmative result of test 67 reaches a test 69 to determine if X equals zero. If it does, that means that none of the available cars can reach the call within the time limit, with the time limit at its present setting, and that therefore the time limit should be increased to equal the smallest of the stored values. This will ensure that an acceptable match will be found on the next iteration. Then, the routine reverts to step 50 so as to try the process all over again in this direction with the new limit.

On the other hand, if X is not equal to zero, then at least one car has placed the ONE in its table for the hall call in this direction at this floor. A negative result of test 69 reaches the test 54 to determine if all of the floors have been tested for hall calls and had response times determined. Initially, that will not be the case so a negative result of test 54 reaches the step 55 to increment the floor pointer.

When all of the floors have had the wait time determined for all their up calls, an affirmative result of test 54 reaches a test 76 to determine if the direction pointer is set to DOWN, or not. At first, it is not, so a negative result of test 76 reaches a step 77 to set the direction pointer to DOWN. Then all the steps and tests 50-54 are repeated for calls in the down direction. After that, an affirmative result of test 76 will reach a point 78 where the program can either revert to other routines, or return to step 49, if parallel processing is used.

Figure 4:
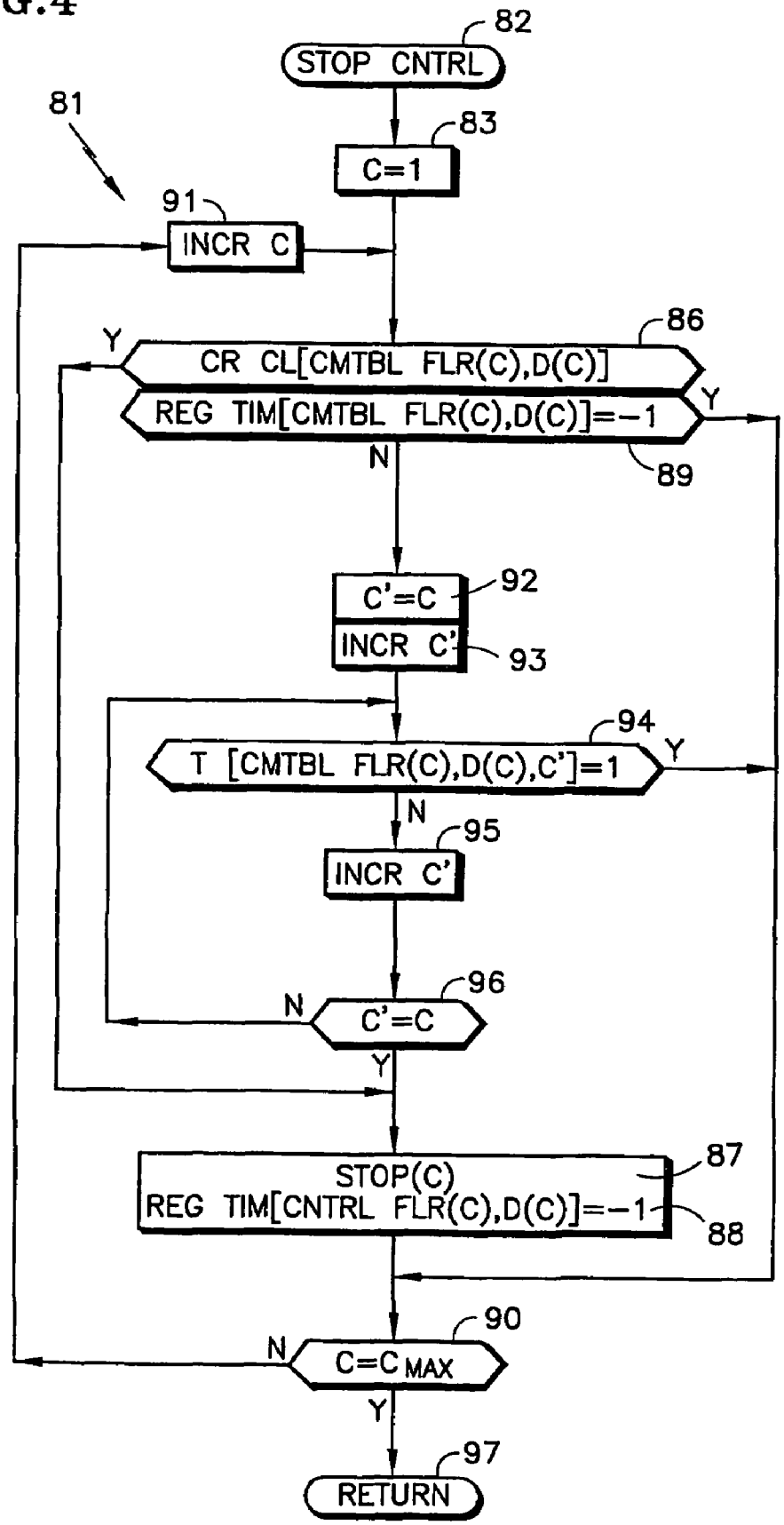

The heart of the present invention is illustrated in a routine 81 of FIG. 4 which is reached through an entry point 82 to control stopping of the cars to answer calls. A first step 83 sets a car counter equal to one. Then a test 86 determines if there is a car call at the committable floor of car C in the direction, D, that car C is traveling. If there is, an affirmative result of test 86 reaches a step 87 to issue a stop command for car C, and a step 88 to set the registration time for calls at the committable floor of car C in the direction of car C equal to −1. This is the value tested for in test 37 of FIG. 2. This factor is also tested for in a test 89; if test 89 is affirmative, this means that there is no hall call at the car's committable floor so an affirmative result of test 89 bypasses the steps 87 and 88. A test 90 determines if all of the cars have been considered or not. Initially they will not, so a negative result of test 90 reaches a step 91 to increment the car pointer, and the tests 89 and/or 86 will again be given consideration for the next car in turn. If the registration time for a call in the direction of the car at the committable floor of the car is set to other than −1, that means that there is a call, and it must be determined whether or not other cars might be able to answer that call within the wait time limit. This is an important characteristic of the present invention. If other cars can answer the call within the wait time limit, then this car will not do so. It should be noted that this is a radical departure from dispatching notions of the prior art.

A negative result of test 89 reaches a step 92 which sets a backup car pointer, C' equal to the car pointer, C. Then C' is incremented in a step 93 so as to point to a car other than the one currently being considered for a stop, or not. A test 94 determines if the table entry for the car C', at the committable floor of car C and the direction of car C is equal to a ONE. If it is, this means that this other car, C', can answer the call at the committable floor of C in C's direction within the time limit, and therefore car C shall not answer it, in accordance with the precepts of the present invention. Thus, an affirmative result of test 94 will bypass the stop command at step 87 and reach the test 90 to see if all the cars have been tested or not. On the other hand, if the table entry for car C' is a ZERO, a negative result of test 94 will reach a step 95 to increment C', and a test 96 determines if C' has advanced back to C or not. Thus, this process will only test all the cars other than C in the test 94.

When all of the cars have been tested to see if they can answer the call, thereby preventing car C from doing so, without the routine being diverted by means of an affirmative result of test 94, then an affirmative result of test 96 will reach step 87 to issue a stop command for car C, and step 88 to set the registration time for the call at the committable floor and direction of car C equal to −1, once again.

When all cars have been tested to see if they should stop or not, an affirmative result of test 90 will reach a point 97 through which either other parts of the programming can be reverted to, or this routine may revert to step 83 so as to provide the process all over again. The routine of FIG. 4 should be reached at least more than once in each period of time during which a car can pass a floor at its highest speed.

Figure 5:
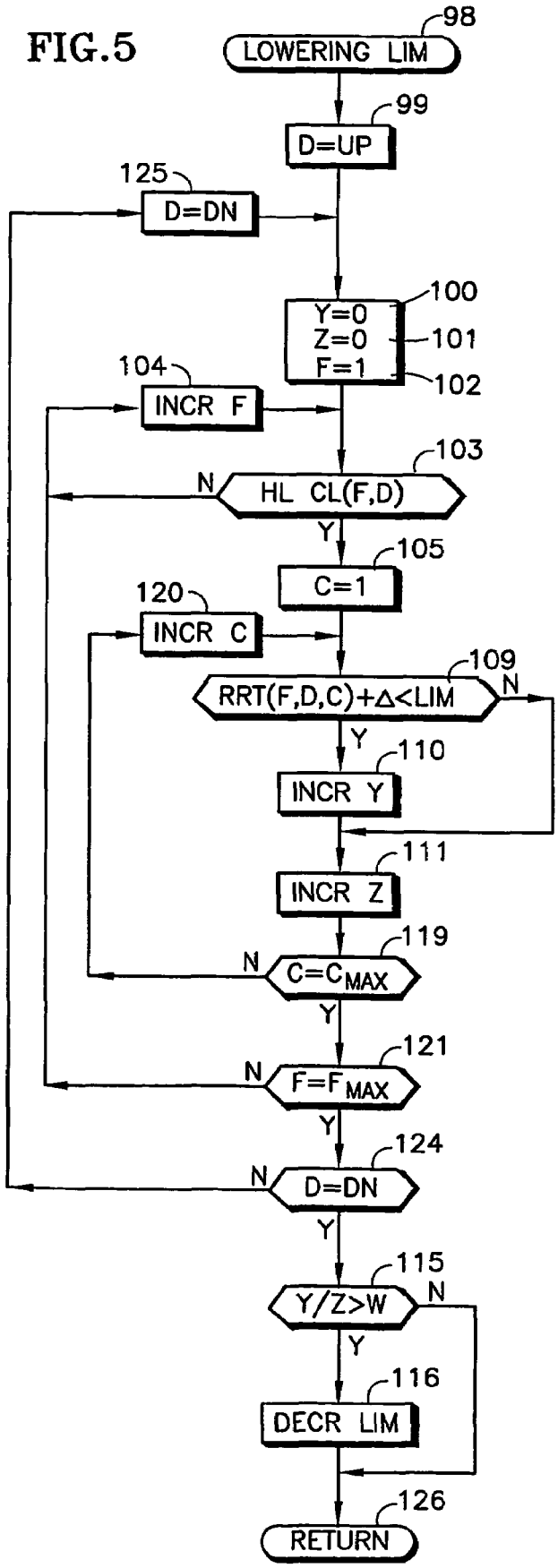

As described previously with respect to FIG. 3, if no cars can answer the call within the wait limit, this means the wait limit must be raised (as generally will be true in the early parts of the morning rush hour). Lowering of the limit however is accomplished in a routine illustrated in FIG. 5. This routine is reached through an entry point 98 and a first step 99 sets the direction pointer to UP. Then a step 100 sets a counter, Y, which will determine the number of calls having a call response time within the time limit, to ZERO. A step 101 sets a counter, Z, that will determine the total number of call response times. A step 102 sets the floor pointer to one, and a test 103 determines if there is a hall call at the floor and direction indicated by the pointers. If there is not, a negative result of test 103 reaches a step 104 to increment the floor pointer and test 103 is repeated. Ultimately, an affirmative result of test 103 will reach a step 105 which sets a car pointer, C, to ONE, and then a test 109 determines if the remaining response time for car C to reach floor F, in direction D plus some increment, is less than the current limit. If it is, a step 110 will increment the Y counter, and then a step 111 will increment the Z counter. On the other hand, if the remaining response time for the call in question is not within the increment of the limit, a negative result of test 109 will go directly to step 111 to increment the Z counter. The purpose for this is illustrated in a test 115, near the bottom of FIG. 5, where if the ratio of Y to Z is greater than some setable number, W, then the limit is decremented in a step 116; otherwise, step 116 will be bypassed.

After incrementing the Z counter and possibly the Y counter, a test 119 determines if all cars have had the response time to this call compared against the time limit, or not. If not, a step 120 increments the car pointer and the test 109 is repeated for the next car in turn. When all cars have been tested for response time to the particular call in question, an affirmative result of test 119 reaches a test 121 to determine if all of the calls in the present direction (initially, UP) have had their response times compared against the limit. If not, the step 104 will increment the floor pointer and the steps and tests 103-121 are repeated for the next floor in turn.

When all of the floors have been tested with respect to this direction, a test 124 determines if the direction pointer is set to DOWN; if not, a step 125 sets the direction pointer to DOWN and all of the steps and tests 100-124 are repeated again for all of the floors and all of the cars. Eventually, all of the outstanding calls are tested to see if the response times of all of the cars are more than some increment lower than the current time limit. If the ratio of those that are so is high enough, test 115 will be affirmative reaching step 116 to decrement the limit. But if not, a negative result of test 115 bypasses the step 116, and a point 126 is reached where the routine can either revert to the step 99, or cause the other parts of the program to be reached, depending on whether parallel processing is used, or not.

Figure 6:
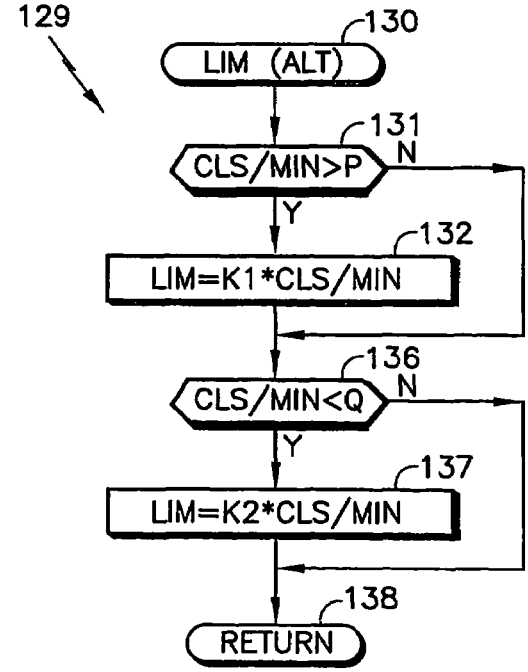

The adjusting of the limit described hereinbefore with respect to FIGS. 3 (step 73) and 5 (step 116) may be done in various other ways. One example is illustrated in a routine 129 set forth in FIG. 6. Therein, the routine is reached through an entry point 130 and a first test 131 determines if the number of calls being registered per minute is greater than some constant, P. If it is, then the limit may be adjusted upwardly in a step 132 by setting the limit equal to some constant, K1, times the traffic rate (calls per minute). Otherwise, a negative result of test 131 can bypass the step 132. Similarly, a test 136 will determine if the traffic rate in calls per minute is less than some constant, K2. If it is, then the limit may be lowered in a step 137 by being set equal to some constant, K2 times the traffic rate. Otherwise, a negative result of test 136 will bypass the step 137.

In this fashion, the limit is lower during light traffic so that the waiting for response of the cars is minimized, thereby making full utilization of the available capacity of the elevator system. On the other hand, when traffic is very heavy, the limit can be increased so that real time service allocation of the invention, in which all of the calls are delayed a little bit in order that the system retains sufficient slack so as to be able to handle perturbations and momentary excessive traffic demand, without causing an excessive number of unduly long-wait calls, bunching, and other traditional undesirable elevator system responses. Alternatively, a map of limits as a function of traffic rate may be set out in a look-up table. When testing for adjusting the limits is complete, a point 138 is reached from which the routine of FIG. 6 may revert to the test 131, if parallel processing is utilized, or may cause other programming to be reached.

The invention has been described, thus far, without any reference to whether ordinary up/down hall calls, or destination-indicating hall calls are being processed in the building utilizing the present invention. In the general case, the invention will work with either system. However, it is deemed highly preferable that the invention be utilized in a destination-call system so that the remaining response times determined in subroutine 56 of FIG. 3, for use primarily in the test 62 of FIG. 3 (but also in test 109 of FIG. 5, if used), will be accurate: the dispatching system, when calculating remaining response time, will be able to take into account the destination floor, that is, the car calls that will be placed once the hall call is answered. If destination-indicating hall calls are not utilized, remaining response time calculations can include historical indications of likely destination floors for calls answered in the present time interval of a present day, using known artificial intelligence techniques, to provide a certain average accuracy of remaining response time. Then, the system can work to an effective degree by controlling the limits appropriately. If destination calls are used, the call buttons would be in a ten key device, or in a panel much like the car call button panels 20 (FIG. 1) instead of up/down call buttons 21.

One aspect of the present invention is that because each car is caused to stop at a committable floor, if there is a hall call at that floor that no other car can reach within the limit, even if the present car at that committable floor also has not reached that call within the time limit, that car will nonetheless answer the call. In other words, the calls will be answered, even though some of them may fall just outside the limit in the event that certain perturbations cause that to occur.

The invention claimed is:

1. A method of real-time service allocation of cars to respond to hall calls, comprising:

recording (38) the time that each hall call (21) is registered;

determining (56) for each car that is available to answer hall calls in the elevator system, the predicted remaining response time for such car to reach each such call;

determining (62) the predicted wait time for each car to answer a call as the summation of the predicted remaining response time for that car to reach the call and the amount of time for which that call has remained unanswered currently;

characterized by:

providing (62-65) a matrical table having an entry for each car with respect to each possible hall call in the system, said table having an indication of whether said predicted wait time for each car to reach each outstanding call is less than (63) a predetermined wait time limit;

for each car, determining (94) whether there is any other car in the system that can reach a call in the direction and at the committable floor of that car, or not; and causing a particular car to stop (87) at its committable floor only if there is a car call in said particular car for that floor (86) or if there is no other car that can reach that call within said wait time limit, as indicated by said matrical table.

2. A method according to claim 1 wherein said wait time limit is adjusted upwardly (73, 132) in heavy traffic and downwardly (116, 137) in light traffic.

* * * * *